United States Patent [19]

Borland et al.

[11] Patent Number: 4,775,123

[45] Date of Patent: Oct. 4, 1988

[54] DEVICE FOR HOLDING A BAG

[75] Inventors: John C. Borland; Thomas E. Northam, both of Box 2140, Winkler, Manitoba, Canada, R0G 2X0; Ron Dykstra, Winkler, Canada

[73] Assignees: John C. Borland; Thomas Edward Northam, both of Winkler, Canada

[21] Appl. No.: 74,235

[22] Filed: Jul. 16, 1987

[30] Foreign Application Priority Data

Jul. 16, 1986 [GB] United Kingdom ..... 8617326

[51] Int. Cl.[4] ..... B65B 67/04

[52] U.S. Cl. ..... 248/99; 15/257.1

[58] Field of Search ..... 248/97, 98, 99, 100, 248/101; 294/1.4, 55; 141/108, 314, 391; 15/257.4, 257.6, 257.7, 257.8, 257.9; 53/390

[56] References Cited

U.S. PATENT DOCUMENTS

| | | | |
|---|---|---|---|
| D. 263,512 | 3/1982 | Kawada . | |
| 490,578 | 1/1893 | Merry | 248/99 |
| 3,532,314 | 10/1970 | Vosbikian . | |
| 3,684,225 | 8/1972 | Crawford | 248/99 |
| 3,754,785 | 8/1973 | Anderson | 248/99 X |
| 3,934,803 | 1/1976 | Frederick | 15/257.1 X |
| 4,048,691 | 9/1977 | Spangler | 15/257.1 |
| 4,149,745 | 4/1979 | Willis . | |
| 4,159,139 | 6/1979 | Gawedzinski . | |
| 4,268,081 | 5/1981 | Hawkinson . | |
| 4,282,911 | 8/1981 | Sumitomo . | |
| 4,457,483 | 7/1984 | Gagne | 248/97 |
| 4,530,533 | 7/1985 | Dieter | 248/99 X |
| 4,610,039 | 9/1986 | Stern | 248/99 X |
| 4,659,045 | 4/1987 | Flynn | 15/257.9 X |
| 4,664,348 | 5/1987 | Corsaut | 15/257.1 X |

*Primary Examiner*—J. Franklin Foss

*Attorney, Agent, or Firm*—Adrian D. Battison; Stanley G. Ade

[57] ABSTRACT

A device for holding a bag generally of the thin flexible plastic material type used for garbage bags so the mouth of the bag is held open and is held fixed to the holding device comprises a hoop or tubular member which is an upper edge which is flared on a lower edge of reduced circumferential dimension. The bag is thus passed upwardly through the hollow interior and wrapped around the upper edge so the edge of the mouth of the bag lies in the outer side of the device. Latching arrangements provided centrally of an arch portion and centrally of a blade portion of the device comprise a finger hold and a slot with the slot breaking out on the lower edge. In operation the edge of the bag is pressed through the finger hold to provide a tail on the inside of the device and then the tail is pulled against the lower edge of the device so that it enters into the slot to be clumped thereby. This allows the edge of the bag to be tightened around the device at the reduced diameter portion so as to prevent the bag being pulled over the upper edge which is curbed to provide a smooth engagement.

7 Claims, 2 Drawing Sheets

DEVICE FOR HOLDING A BAG

BACKGROUND OF THE INVENTION

This invention relates to a device for holding a bag such that a mouth of the bag is held open for receiving material to be placed in the bag, and particularly but not exclusively to a device for holding or supporting a garbage bag in such a manner that the mouth of the bag is held open so that garbage or the like can be swept in or dropped in.

There are very many occasions in which it is required to sweep materials into a garbage bag either in household use or in garden use. The materials may be garbage on the floor of the house for example from a spill or from reconstruction or redecorating work or may, in the garden, be leaves, clippings or the like.

Devices have been proposed for attachment to the mouth of a garbage bag for holding the garbage bag open so that a sweeping movement can be made over one edge of the garbage bag to collect material directly into the garbage bag. However, these devices have not been entirely satisfactory and particularly the method of connection of the garbage bag to the device has been very limited in that the device can merely slip away from the bag if the device is lifted while the weight of the material is supported in the garbage bag. In addition, it is often required to hold open the mouth of the bag while the bag is supported in a manner which allows it to be carried around or stored in a suitable location. Devices are provided which comprise a ring around which the edge of the bag is wrapped and then secured in place either by an elastic cord or a rigid ring so as to clamp the bag edge around an outer surface of the inner ring. However, these are difficult to operate, ineffective and are not suitable for sweeping material into the bag and thus are generally limited to stationary use.

SUMMARY OF THE INVENTION

It is one object of the present invention, therefore, to provide an improved device for holding a bag of this general type which can attach more firmly to the bag so that merely by lifting the device, the bag and contained materials can be lifted without danger of the bag slipping away from the device.

According to a first aspect of the invention, therefore, there is provided a device for holding a mouth of a bag in an opened condition for receiving material to be placed in the bag, the device comprising a generally tubular body having an upper end and a lower end each defined by an edge of the body and a hollow interior extending through the body from the upper end to the lower end, the circumference of the body being arranged such that an edge of the bag at the mouth thereof can be wrapped therearound, means defined a plurality of slots formed in the body with the slots being spaced around the circumference of the body and each slot breaking out on an edge surface of the body so that a portion of the bag can be pressed against the edge surface at the slot so as to enter the slot, the slot being shaped to clamp and retain said portion of bag material therein.

The edge surface can be defined by one of the upper and lower edges or by an internally formed surface of the body.

According to a second aspect of the invention, there is provided a device for holding a mouth of a bag in an opened condition for receiving material to be placed in the bag, the device comprising a generally tubular body having an upper end and a lower end each defined by an edge of the body and a hollow interior extending through the body from the upper end to the lower end, the circumference of the body at the upper end being arranged such that an edge of the bag at the mouth thereof can be wrapped around the upper end with the body of the bag passing from the upper end through the hollow interior to hang from the lower end, finger hole means provided through said body at a position spaced from said upper edge and arranged such that a portion of the bag edge can be pressed through the hole means from an outer surface of the body to the interior of the body to tighten the bag edge around the body, and notch means on the body for receiving and clamping said portion.

Preferably, the notch means is provided by a slot with the edge on which the slot breaks out being the lower edge of the device. In one alternative arrangement the slot may break out in an edge generated internally of the device by a hole or opening through the device which exposes an edge.

The body thus includes preferably an opening substantially of the order of the size of a finger of the user so that the user can press the bag material through the opening with the finger to generate a tail of the bag material which can then be placed into the slot by pressing that tail against the edge. That edge may be within the opening itself or that edge may more preferably be on the lower edge of the device with the finger hole arranged adjacent to that edge.

Preferably the slot opens into a V-shape at the edge so that the material can be allowed to enter without difficulty. In addition the slot may include a small opening or enlargement at or adjacent its end remote from the edge. The size of the enlargement is very much smaller than that of the finger hole and acts while clamping the bag tail in normal use to allow the tail to be removed with less difficulty. Furthermore, the edges of the slot at the intersection with the inner and outer surfaces of the body are chamfered or rounded to facilitate the action of engaging and disengaging the tail of the bag.

Preferably the device includes a sweeping edge thus forming a substantially flat or blade shaped edge and an arch extending away from that edge so the arch can extend upwardly from the ground with the blade pressed against the ground thus holding the bag against the ground for sweeping the material over the edge into the bag. Preferably the blade is slightly bowed at a centre area so to more readily retain the blade against the ground when it is pressed against the ground and to avoid the central area bowing upwardly and allowing material to pass underneath the blade. The arch portion can also include a rounded flanged upper edge to provide greater rigidity and to avoid sharp cutting edges which could otherwise damage the bag as it wraps around the upper edge from the interior of the body to the bag edge which is wrapped tightly around the outer surface of the body. The blade portion has however a generally sharp upper edge to assist in allowing the material to be swept over that edge.

Preferably there are two such slots in the device at the lower or rear edge, one at the top of the arch and one at the centre of the blade and each having an adjacent finger hole.

In addition there may be provided a support bracket in the form of a U-shaped member into which the blade is inserted for supporting the tubular body and the bag. This is shaped to support the upper edge substantially horizontal and to allow it to break out by flexing of the U-shape if impacted.

The bracket can be mounted either on a suitable wall support or upon a separate support stand which has a handle and a base and possibly wheels so that the handle can be used to carry the support stand, the bracket, the device and the bag all supported thereon with the weight of the bag resting on the base.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
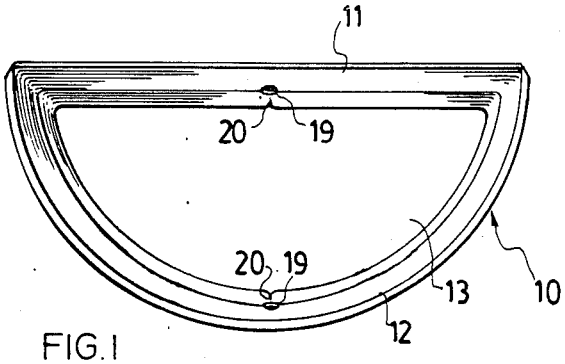
FIG. 1 is a top plan view of a device for holding a bag according to the invention.

Referring firstly to the device as shown in FIGS. 1 through 4, the device comprises a generally tubular member 10 which includes a blade portion 11 and an arch portion 12 defining therebetween a hollow interior or an opening 13. The axial extent of the tubular member 10 is less than the transverse dimension thereof and both the blade portion 11 and the arch portion 12 are outwardly flared from a crease line 25 toward an upper edge 14 relative to a generally cylindrical section 15 adjacent to a lower edge 16.

The hollow interior 13 extends fully through the body or members from the upper end of the body to the lower end with the body formed as a thin wall of thickness just to provide sufficient strength to support the device and a bag. The device is generally moulded in one piece for example by injection moulding or thermo forming.

Figure 2:
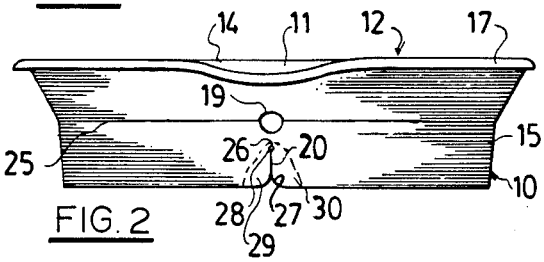
FIG. 2 is a side elevational view of the device of FIG. 1.

The front edge 14 of the blade portion may in fact be bowed outwardly slightly as shown in FIG. 2 away from the plane of the upper edge 14 so as to tend to stretch the material of the bag at that position to hold it taut over the blade area for sweeping.

Figure 4:
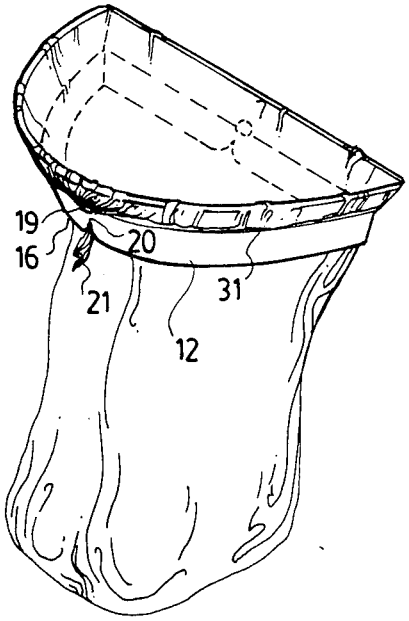
FIG. 4 is an isometric view of the device of FIG. 1 including a bag attached there around.

The upper edge of the body at the arch portion, as is indicated at 17, includes an outwardly curved flange so as to present a smoothly curved edge to the bag when wrapped therearound as shown in FIG. 4.

The centre of the blade portion 11 and the centre of the arch portion 12 both include an arrangement for latching the bag in position at that point. The arrangement comprises a finger hole 19 and a slot 20, the latter of which breaks out on the lower edge 16. The arrangement on both the blade portion and the arch portion operate in the same manner and hence only one of these will be described. Each of the latching arrangements comprises a finger hole 19 which lies substantially on the crease line 25 and has a size so that it just can receive the finger of a user which can be inserted therein from the outer surface of the body through to the hollow interior. Immediately adjacent the finger hole is a slot 20 which is spaced from the finger hole so that it does not break out onto the finger hole but has a closed end adjacent to the finger hole. From the closed end indicated at 26, the slot extends toward the lower edge 16 of the body at which it widens as indicated at 27 to define a V-shape.

Figure 6:
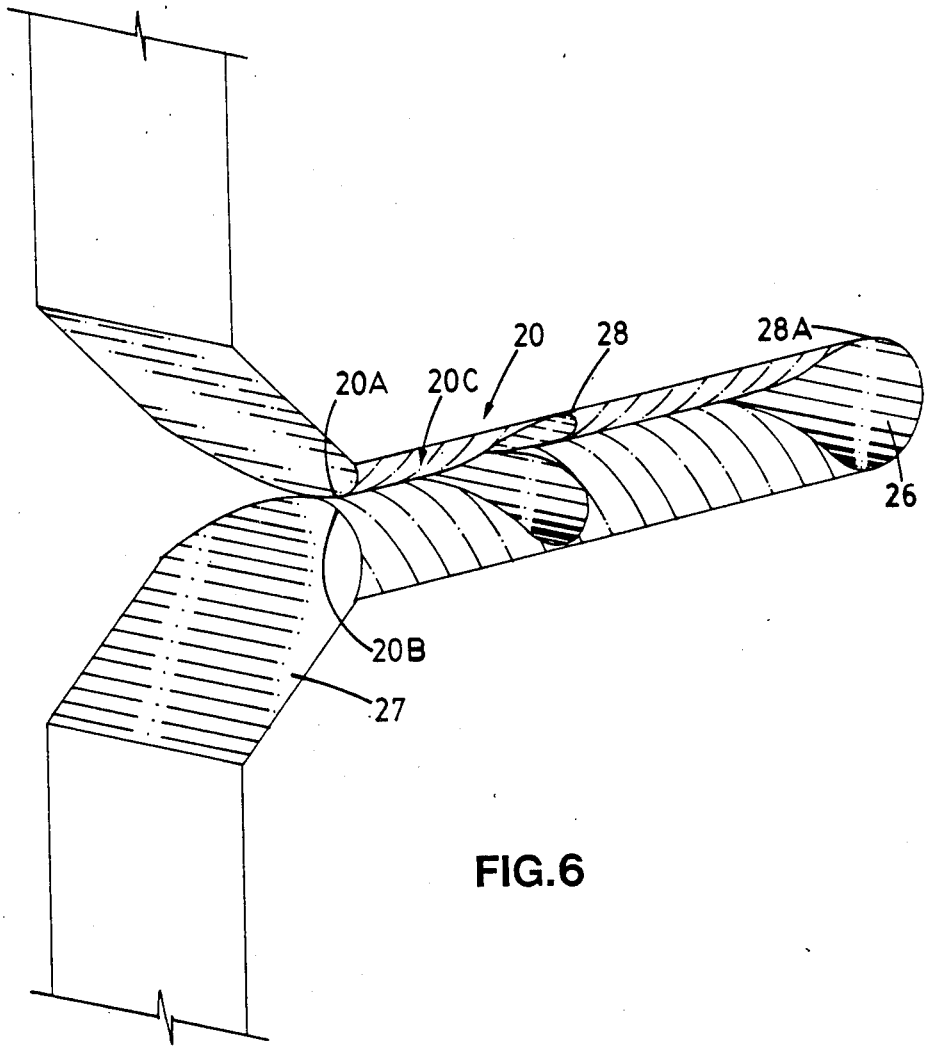
FIG. 6 is an enlarged isometric view of one slot 20 of the device of FIG. 1.

The details of the slot are shown in FIG. 6. The sides of the slot are very closely adjacent or touching as indicated at 20A and 20B so as to trap the material of the bag therein. From the point of closest contact, the sides are curved outwardly toward the intersection with the inner and outer surfaces of the body as indicated at 20C.

An enlargement 28 is formed part way along the length of the slot with the enlargement being significantly less in size then the finger hole and of a size merely just to receive the small portion of bag which is intended to be inserted therein as explained hereinafter.

The enlargement is formed merely by eradicating the curved portions 20C at that point along the length of the slot. A second enlargement 28A is formed in the same manner and of the same size at the closed end 26 of the slot.

As indicated at 29 and 30, each side of the slot is formed by a portion of the body which is of reduced thickness as shown by dotted line so as to allow more ready flexing of that part in a direction generally at right angle to the plane of the body at that part so as to allow opening and closing of the slot simply by twisting those parts 29 and 30 in opposite directions.

As an alternative arrangement (not shown) the body can be modified adjacent the slot to allow the more ready flexing by providing a further slot on one or both sides of the main slot 20. This defines a piece of the body which can be easily flexed away from the body to open the slot 20. In a yet further alternative the body on only one side of the slot is modified to allow more simple flexing since it is of course necessary only to open the slot to allow the material in and out as described hereinafter.

Although latching arrangements are only shown at the centre of the blade portion and the centre of the arch, it is possible to provide only a single latching arrangement although this is less preferred since it provides a less effective attachment of the bag. It is also possible of course to provide more latching arrangements.

In operation the device is arranged relative to the bag so that the bag passes through the hollow interior with the edge of the bag above the upper edge of the body. The upper edge indicated at 31 in FIG. 4 is then wrapped over the upper edge so as to surround the outer surface of the body at a position part way down the outer surface so as to at least reach the finger holds 19. As the bag is generally of a larger circumference than the circumference of the device, the edge 31 is loosely wrapped around the outer surface at this stage.

The finger of the user is then used to push a part of the bag material in a direction from the outer surface of the body through to the inner surface of the body through the finger hole 19. This tends to form a tail of the bag material which includes a piece of the edge of the bag material together with a further part of the bag material which causes tensioning of the edge 31 around the outer surface of the body. The tail is then tucked inside the body and can be pulled downwardly from the inner surface of the body toward the lower edge 16. The tail is indicated at 21 in FIG. 4 and is then pulled over the lower edge of the body so as to engage the chamfered edges of the slot 20 thus causing the tail to enter the slot and to extend down the slot as the slot flexes to open to a position where the tail engages the enlargement 28. The tail is thus grasped or latched in effectively a notch means defined by the slot and formed on or carried by the body.

In this position the tail is clamped tightly by the slot and is thus prevented from slipping away from the slot so the material is pulled through the finger hole and thus tightened around the upper edge of the body and around the outer surface of the body.

The same process is then repeated at the other of the latching arrangements to provide sufficient tensioning of the edge 31 so that it is tight around the body at the crease line 25.

As the body flares from the crease line outwardly toward the upper edge, even though the tension in the edge 31 may not be great, the bag is prevented from being pulled over the upper edge of the body since to do so the edge 31 must be stretched significantly to reach the circumference of the upper edge.

The curvature of the flange at the upper edge also acts to increase the friction between the upper edge and the bag so that a pulling of the bag for example adjacent the junction between the arch portion and the blade portion will not cause that portion of the bag to slip over the upper edge since the friction caused by the stretching of the edge 31 will restrict or halt any movement of the bag over the upper edge even at the least supported positions most remote from the latching arrangements.

Thus the weight of the bag and also the contents of the bag can be held upon the body without danger of the bag being pulled away from the upper edge of the body.

When it is desired to release the bag for removal of the device so the bag for example can be tied and stored, the tail 21 is fully exposed at the front of the body that is at the outer surface of the body even though the bag itself may be pressed vigorously against the inner surface of the body. The tail can thus be slipped out of the slot or notch by a slight distortion of the slot by twisting the readily flexible portions 29 or 30 as required. The tail is thus lowered out of the slot so that it is free from the slot, following which the edge 31 can be pulled to release the tail portion from its position within the finger hole 19. Even though the material in the bag may be pressing against the inner surface of the body, it is not possible for the material to be pressing so significantly that it prevents the tail from simply sliding out of the finger hole since there is little friction to be overcome.

With both of the latching arrangements released, the device can be lifted upwardly away from the bag with the bag edge simply sliding over the upper edge of the device until the device is fully released and free from the bag.

Figure 5:
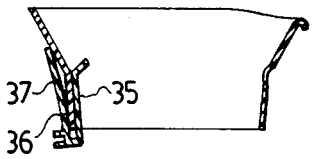
FIG. 5 is a cross-sectional view of the device of FIG. 1 including a bracket for supporting the device.

Turning now to FIG. 5, there is shown a bracket for supporting the holding device in a substantially horizontal condition. The bracket can be carried for example on a suitable wall or other surface so the bag can be inserted in place on the device and the bag held with its mouth open adjacent for example a work bench or the like.

Alternatively the bracket can be mounted upon a stand or upon a wheeled trolley with the stand or trolley providing a horizontal base which supports the lower end of the bag. The bracket also provides means for receiving additional empty bags which can be put in place when the bag attached to the holding device has been filled.

The bracket comprises a basically V-shaped device formed by a front wall 35 and a rear wall 36 with the rear wall 36 attached to a plate member 37 with suitable screw or bolt holes for attachment to the wall or stand. The front wall 35 is sufficiently flexible so that the blade portion can be inserted therein as a press fit so as to support the holding device with the upper edge substantially horizontal. The front portion 35 is also sufficiently flexible to allow the blade portion to jump out of the bracket should it be impacted with sufficient force to avoid damage to any object impacting the holding device or to the device itself.

Figure 3:
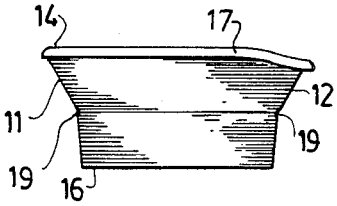
FIG. 3 is an end elevational view of the device of FIG. 1.

It should be noted that the device as shown in FIGS. 1, 2 and 3 has the following advantageous features:

1. It can be used to hold the bag mouth either vertical for sweeping or horizontal (on the bracket or any other suitable support) for receiving dropped materials.
2. The bag can be emptied and re-used while remaining attached to the device.
3. The device can accommodate different size, shape and design of bags by the user modifying the size of the tail.
4. When the bag is filled to the top edge 16 of the device, just sufficient bag material remains available when the tails are removed from the device for the mouth of the bag to be closed, gathered and tied.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A device for holding a mouth of a bag in an opened condition for receiving material to be placed in the bag, the device comprising a generally tubular body having an upper end and a lower end each defined by an edge of the body and a hollow interior extending through the body from the upper end to the lower end, the body having a substantially flat side portion and an arch side portion, an edge of the flat side portion at the upper end defining a blade, an edge and arch side portion at the upper end defining an outwardly curved flange, a plurality of finger holes in the body arranged at spaced positions around the circumference of the body and each extending through the body at a position between the upper and lower ends and sized to receive a single finger, the circumference of the edge of the upper end of the body being arranged such that an edge of the bag at the mouth of the bag can be wrapped therearound and being greater than the circumference of the body at said finger holes and at said lower end, and means defining a plurality of slots formed in the body with the slots being spaced around the circumference of the body and each slot breaking out on said edge of the body at the lower end and being arranged adjacent a respective one of the finger holes so that a portion of the bag can be pressed through a respective one of the holes to form a tail and the tail can be pressed against said edge at the slot so as to enter the slot, the slot being shaped to clamp and retain said portion of bag material therein.

2. A device for holding a mouth of a bag in an opened condition for receiving material to be placed in the bag, the device comprising a generally tubular body having an upper end and a lower end each defined by an edge of the body and a hollow interior extending through the body from the upper end to the lower end, the circumference of the body at the upper end being arranged such that an edge of the bag at the mouth thereof can be wrapped around the upper end with the body of the bag passing from the upper end through the hollow interior to hang from the lower end, finger hole means provided through said body at a position spaced from said upper edge and arranged such that a portion of the bag edge can be pressed through the hole means from an outer surface of the body to the interior of the body to tighten the bag edge around the body, and notch means on the body for receiving and clamping said portion, said notch means comprising a slot having one end breaking out on said lower end of the body, said slot being defined by two adjacent edges of the body which lie closely adjacent along a center line thereof and are shaped such that the spacing therebetween increases from said center line toward a point of intersection with surfaces of the body, a portion of the body on at least one side of the slot being of reduced thickness relative to the thickness of other parts of the body, said slot including a first hole through the body at an end of the slot remote from the edge of the body and a second hole through the body intermediate the length of the slot.

3. The invention according to claim 1 wherein said body includes only one finger hole means in said flat side portion and only one finger hole means in said arch side portion, each of said finger hole means having associated therewith a respective notch means.

4. The invention according to claim 1 wherein said slot has an enlargement therein of increased transverse width at a , intermediate position there along spaced from said edge of the body and spaced from an end of the slot remote from the edge of the body such that the portion of bag material can slide along said slot into said enlargement to be received in said enlargement and clamped thereby.

5. The invention according to claim 4 wherein the body on at least one side of the slot at the edge is arranged to be more flexibly deformable in a direction out of the plane of the body than is the remainder of the body to allow more ready distortion of the slot to allow sliding therealong of said portion of bag material.

6. The invention according to claim 1 wherein sides of the slot are curved at the intersection thereof with inner and outer surfaces of said body such that the spacing between edges of the body forming the slot increases from a center line thereof toward said inner and outer surfaces of the body.

7. The invention according to claim 1 including mounting clip means forming a U-shaped body into which one side of said flat side portion of said tubular body can be inserted to maintain said tubular body in a substantially horizontal condition with said bag depending from said lower end thereof

* * * * *